United States Patent [19]

Kellner

[11] 4,040,494

[45] Aug. 9, 1977

[54] DRILL DIRECTOR

[75] Inventor: Jackson M. Kellner, Midland, Tex.

[73] Assignee: Smith International, Inc., Midland, Tex.

[21] Appl. No.: 613,060

[22] Filed: Sept. 15, 1975

Related U.S. Application Data

[63] Continuation-in-part of Ser. No. 584,736, June 9, 1975, which is a continuation of Ser. No. 505,450, Sept. 13, 1974, abandoned, which is a continuation of Ser. No. 419,106, Nov. 26, 1973, abandoned.

[51] Int. Cl.[2] ..... E21B 7/04

[52] U.S. Cl. ..... 175/45; 175/61; 175/73; 175/94; 175/230

[58] Field of Search ..... 175/24, 45, 61, 73–77, 175/79, 81, 94, 230

[56] References Cited

U.S. PATENT DOCUMENTS

| | | | |
|---|---|---|---|
| 2,890,859 | 6/1959 | Garrison | 175/107 X |
| 2,953,350 | 9/1960 | Moore | 175/45 X |
| 3,023,821 | 7/1962 | Etherington | 175/81 |
| 3,126,971 | 3/1964 | Kellner et al. | 175/81 X |
| 3,298,449 | 1/1967 | Bachman et al. | 175/94 X |
| 3,326,305 | 6/1967 | Garrett et al. | 175/76 X |
| 3,561,549 | 2/1971 | Garrison et al. | 175/76 |
| 3,581,404 | 5/1968 | Sanfead | 175/45 X |
| 3,791,042 | 2/1974 | Bell | 175/45 |
| 3,823,787 | 7/1974 | Haworth et al. | 175/45 |
| 3,853,186 | 12/1974 | Dahl et al. | 175/73 |
| 3,888,319 | 6/1975 | Bourne, Jr. et al. | 75/24 X |

*Primary Examiner*—Ernest R. Purser
*Assistant Examiner*—Richard E. Favreau
*Attorney, Agent, or Firm*—Murray Robinson

[57] ABSTRACT

The casing of a drill motor axis is provided with a deflection barrel free to turn to position the barrel relative to the motor to apply lateral force to the side of the motor directed along any desired radius. A gravity actuated mercury potentiometer connected to the barrel provides a barrel orientation responsive electric transmitter for remote indication of the barrel orientation in the hole being drilled. A hydraulic stepping motor and meshing teeth are used to position the barrel azimuthally about the motor axis with the use of vertical alignment means.

19 Claims, 20 Drawing Figures

DRILL DIRECTOR

CROSS-REFERENCES TO RELATED APPLICATIONS

This is a continuation-in-part of prior copending application Ser. No. 584,736, filed June 9, 1975, which is a continuation of prior application Ser. No. 505,450, filed Sept. 13, 1974, now abandoned which is a continuation of prior application Ser. No. 419,106, filed Nov. 26, 1973, now abandoned, and the priority of these three prior applications is claimed.

BACKGROUND OF THE INVENTION

1. Field of Invention

This invention pertains to earth boring and more particularly to drill directing apparatus.

2. Description of Prior Art

It is known to drill a hole in the earth with a rotating bit. In such drilling, the bit may be loaded axially either by the weight of the drill stem to which the bit is connected or by application of fluid pressure to a piston or cylinder connected to the drill stem anywhere along its length between the bit and the mouth of the hole. The bit can be rotated by a motor connected to the drill stem anywhere between its inner end adjacent the bit and its other or outer end, which may be out of the hole at the earth's surface. It is known to guide the bit to cause the hole to be bored in any desired direction. For example, in U.S. Pat. Nos. 3,298,449 to Bachman et al., 3,326,305 to Garrett et al. and 3460639 to Garrett there is shown a bit deflection barrel around the drill stem and through which the drill stem moves axially as drilling proceeds, the drill stem being turned by an out of the hole motor. U.S. Pat. No. 2,637,527 to Andrews shows a deflection and force application barrel about a drill stem projectable into the hole as drilling proceeds and carrying an in-hole motor between the barrel and stem. It is also known to provide bit deflection means affixed to the bit or to the drill stem adjacent the bit, such deflection means moving axially in the hole as the bit proceeds. To take the reaction force of an in-hole bit loading device, an in-hole motor or a bit directing device, it is known to provide anchor means to engage the wall of the hole being drilled. This is shown for example in U.S. Pat. No. 556,718 to Semmer which also shows means for advancing an in-hole motor and bit loading device along the hole as it is drilled. Another example of such anchor means is the construction shown in the U.S. Pat. No. 2,946,578 to DeSmaele. See also U.S. Pat. to Kellner Nos. 3,088,532, 3,105,561, and to Kellner et al U.S. Pat. Nos. 3,180,436, 3,180,437, and to Roberts U.S. Pat. No. 3,225,844.

SUMMARY OF THE INVENTION

According to the invention, a deflection barrel is disposed about the drill shaft, being free to turn thereabout to direct the motor in the desired azimuthal direction. Hydraulic stepping motor and vertical alignment means are provided for turning the barrel as desired relative to the motor. A manifold is connected mechanically to the outer end of the barrel providing means for connecting fluid and electric conduits to the apparatus.

BRIEF DESCRIPTION OF THE DRAWINGS

For a further understanding of the nature and objects of the present invention, reference should be had to the following detailed description, taken in conjunction with the accompanying drawings in which like parts are given like reference numerals and wherein:

FIGS. 1A through 5 together form a view partly in elevation and partly in section and partly in phantom line showing an apparatus embodying the invention;

FIGS. 6 through 16 are transverse and detail sections taken through the apparatus shown in FIGS. 2A through 5 at the indicated planes.

DESCRIPTION OF THE PREFERRED EMBODIMENT

Figure 1:
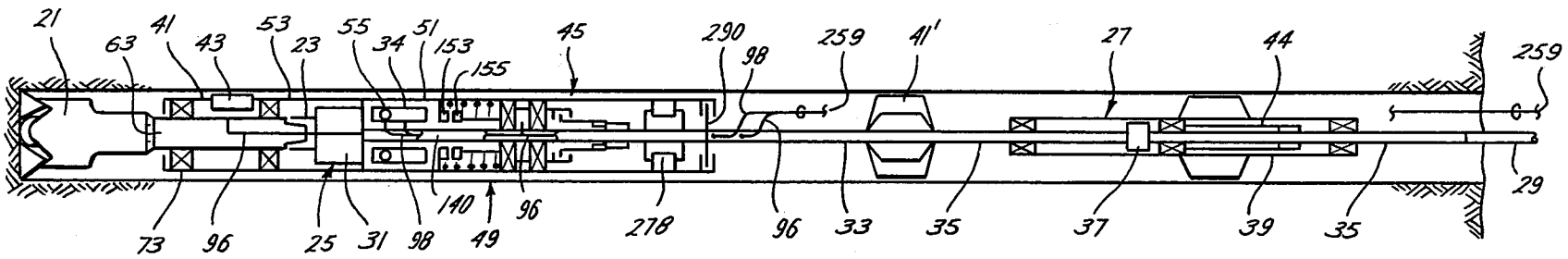
FIG. 1 is a schematic view of a motor with deflection apparatus according to the invention together with associated bit and bit loading apparatus.
Figure 1A:
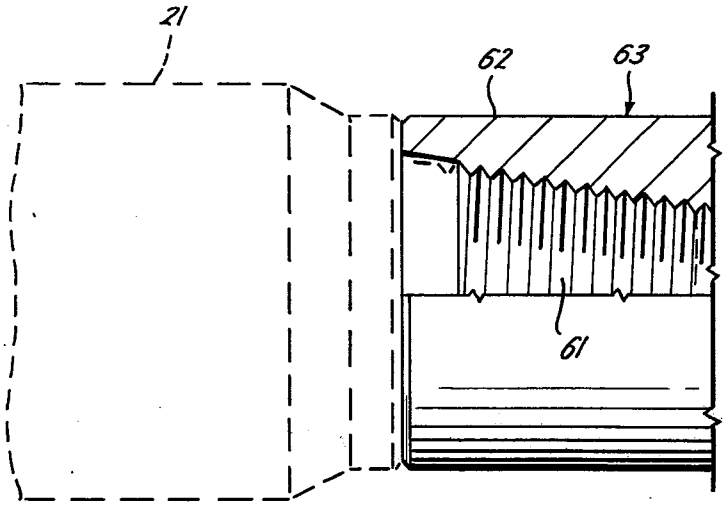
Figure 2A:
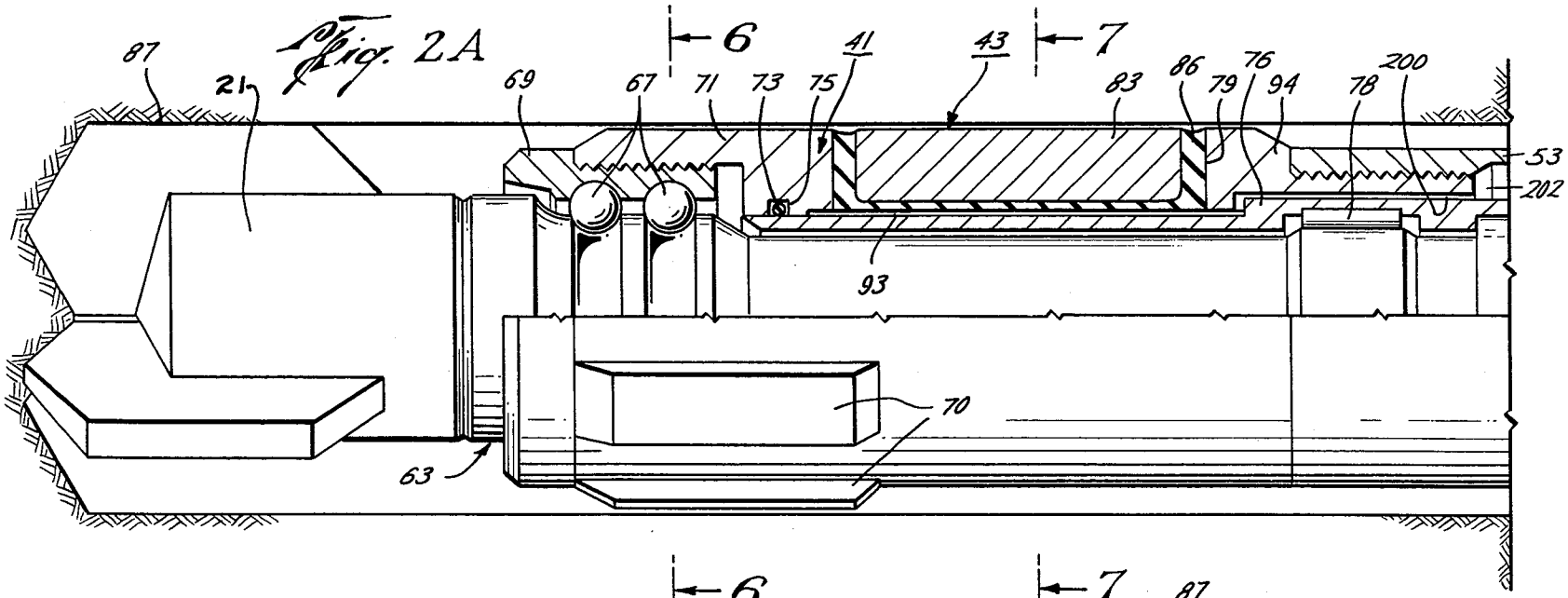

Referring now to FIG. 1 there is shown a drill bit 21 connected to sub 63 extending from shaft 23 of an in-hole motor 25 which in turn is connected to an in-hole force applicator and counter rotation anchor 27 supplied with fluid from conduit bundle 29. Similar apparatus is already known, being disclosed in my U.S. Pat. No. 3,799,277 issued Mar. 26, 1974, entitled "Force Applicator," to which reference is made for details of the construction thereof. Briefly, motor 25 is of the fluid turbine type including shaft 23 and housing 31. Fluid for operating the motor and carrying away the drill bit cuttings is supplied via sleeve 140 which forms the inner end of tubular shaft 33, which also serves to transmit axial force to the motor housing 31 and takes the reaction torque of the motor. A continuation of shaft 33 provides a tubular mandrel or piston rod 35 which carries piston 37 moving in cylinder 39. Mandrel 35 and cylinder 39 are provided with wall anchor means 41', 42 whereby, with the cylinder anchor means actuated, the piston can apply axial force to the motor through thrust ring 290', and with the mandrel anchor means 41' actuated, force can be applied to the cylinder to move it axially along the hole. The piston rod is connected to the cylinder by spline means 44 which allows it to move axially while the anchored cylinder prevents piston rod rotation so that the piston rod can take the reaction torque of the in-hole motor through Sprague or overriding clutch 278.

Figure 16:
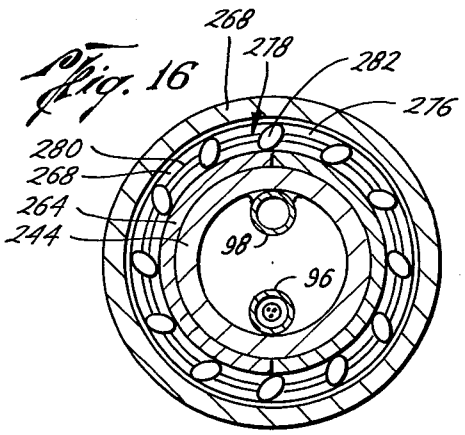
Figure 15:
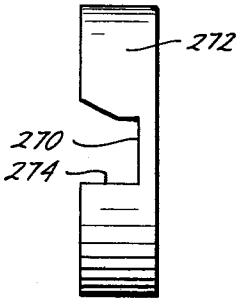
Figure 14:
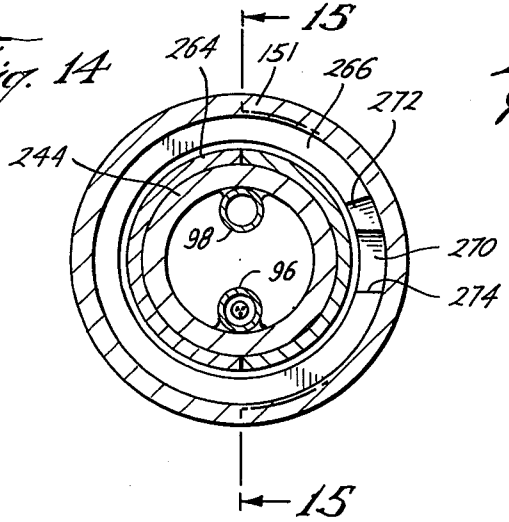

To direct the drill bit, a deflection barrel 41 is provided around the motor shaft extension or sub 63, the barrel being provided with asymetrically disposed wall engaging means 43 to urge the motor and bit to one side of the hole. The wall engaging means 43 are adapted to slide longitudinally along the hole as drilling proceeds. The barrel is rotatable with barrel extension sleeve 53, shrink fitted to motor housing 31, and housing extension 51, about the motor shaft extension 63 to the desired position by means of a hydraulic stepping motor 49 and its teeth means 153, 155, in cooperation with sequencing clutch means 45. A mercury or other type potentiometer 55 as part of instrument package 34 transmits electric potentials to an out of the hole Wheatstone bridge or other detector to indicate the attitude of the hole, as shown in FIG. 16 of allowed parent application, Ser. No. 584,736.

It will be understood that the invention is designed for use in drilling a more or less horizontal hole or holes having at least a horizontal component, so that the gravity actuated mercury potentiometer provides an indication of the attitude of the hole relative to a fixed frame of reference.

Figure 6:
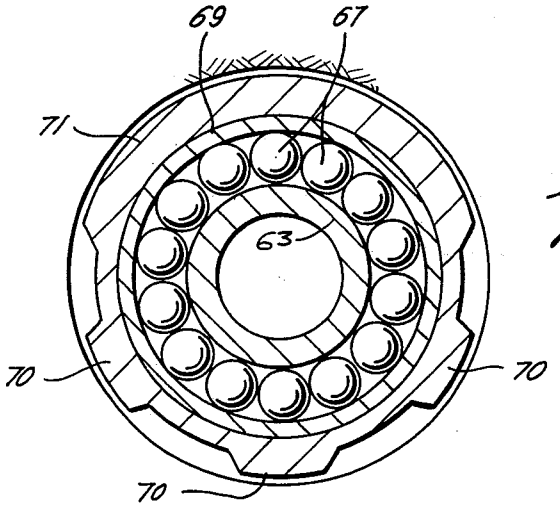

Referring now to FIGS. 1A through 3 there is shown (FIGS. 1A and 2A) a drill bit 21 having a pin 61 screwed into box 62 of sub 63. Sub 63 has its outer end 64 (FIG. 2B) splined onto the inner end 65 of motor shaft 23 by male spline 66 on outer end 64 and female spline 68 on end 65. Heavy radial and axial load ball bearings 67 (see also FIG. 2A and FIG. 6) lie between end 64 and cuff 69 which is screwed to the inner end 71 of deflection barrel 41.

Rate of change control extensions 70 may be mounted on inner end 71 such as by welding to control the rate of change of direction of the hole.

Barrel 41 is connected to shrunk fit motor housing 31 cover 76 is sealed to barrel 41 and motor 25 by annular elastomeric seal rings 73 disposed in annular grooves 75 in inner end 71 (FIG. 2A) and cover 76 (FIG. 2B) respectively. Cover 76 is rotatably mounted on sub 63 by heavy radial load roller bearings 78.

Figure 7:
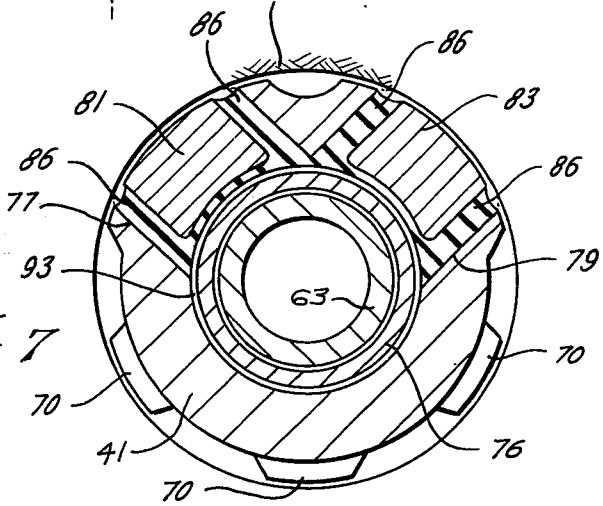

Referring also to FIGS. 1 and 7, two windows 77, 79 in the barrel 41 receive hole wall engaging blocks or pistons 81, 83 to form wall engaging means 43. Between the pistons and the windows is disposed elastomeric mounting means 86 for sealingly mounting the piston in the windows and which allows the pistons to be moved outwardly by pressure differential to engage the wall of hole 87 and which retracts the pistons from wall engaging position, as shown.

Fluid for pushing pistons 81, 83 outwardly is conveyed between elastomeric mounting means 86 and cover 76 through annular space between barrel 41 and cover 75.

Annular channel 200 formed between cover 76 and outer end 94 of barrel 41 is in fluid communication with annular space 93. It is also in fluid communication with outlet 202 of a longitudinal channel 204 formed between motor housing 31 and barrel 41. Channel 204 is in fluid communication with inlet 205 of channel 204. Inlet 205 is in fluid communication with annular space 231 sealed in outer end 206 of motor housing 31 by seals 208, 210. Annular space 231 is in fluid flow communication with outlet 212 of variable size orifice 211 and with inlet 235 of check valve 226, both mounted on sleeve 140.

Variable size orifice 211 comprises outlet 212 and inlet 222 with the passage 224 therebetween being restricted by valve element 220 mounted on threaded shaft 218 terminating in screw head 214. Threaded shaft 218 is sized to threadingly engage threaded hole 216 provided to receive shaft 218 and valve element 220 and vary the distance of insertion of valve element 220 within passage 224 to regulate the flow therethrough.

Check valve 226 comprises inlet 235, outlet 233, and spring 228 holding ball 230 against shoulder 232. This permits flow only from annular space 231 to valve inlet 235 to hydraulic fluid channel 98 via valve outlet 233.

Figure 2B:
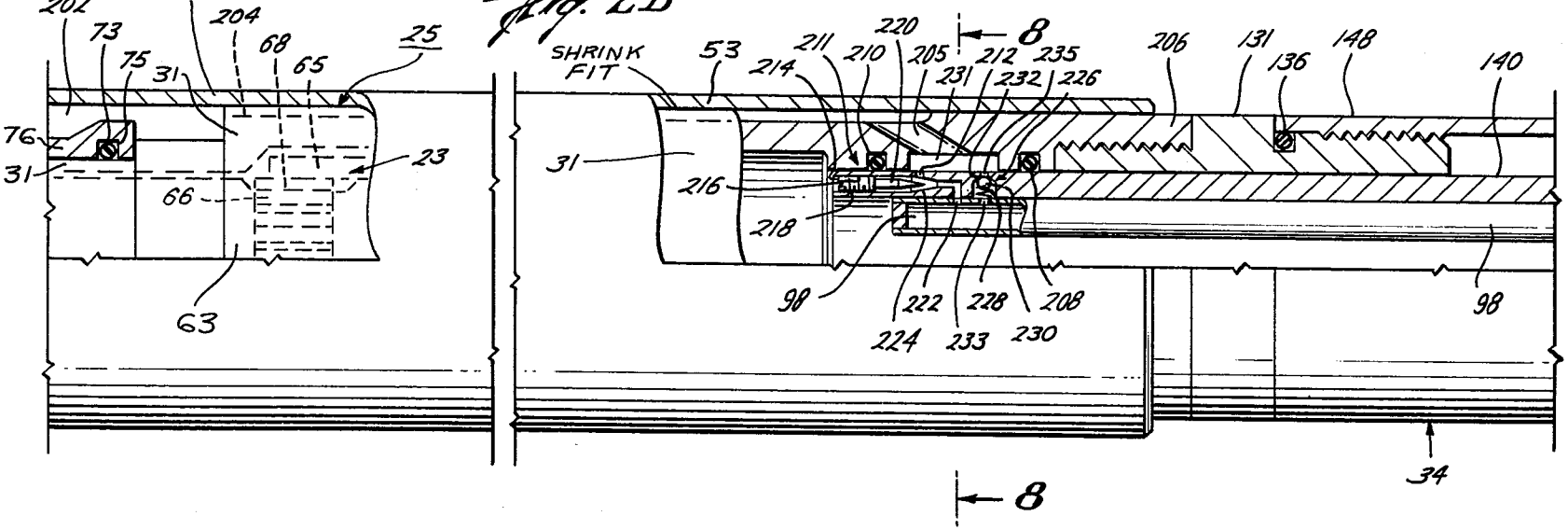
Figure 8:
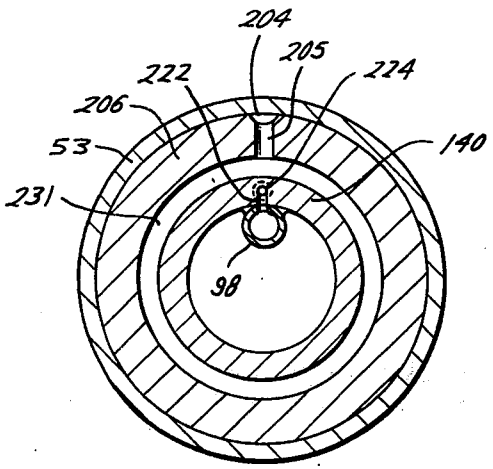
Figure 2C:
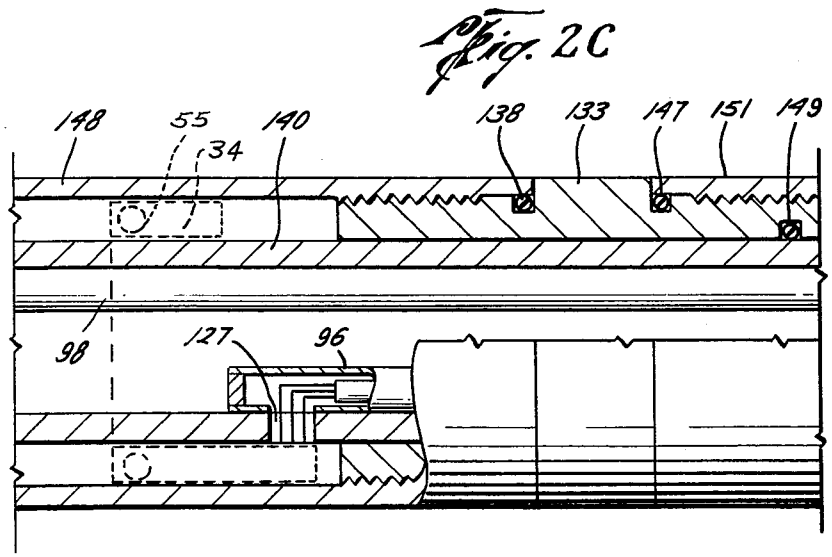
Figure 9:
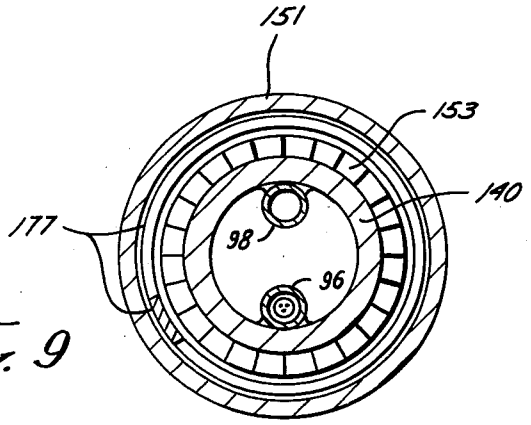

Referring now to FIGS. 1, 2B, and 2C, secured about sleeve 140 between attachment sleeves 131 and 133, having seals 136 and 138 respectively, is instrument package 34 housed under threaded sleeve 148. As part of instrument package 34, there is included potentiometer 55 or other attitude indicating device such as those shown in the *Composite Catalog of Oil Field Equipment And Services* published by World Oil, 31st revision, column 2, pages 2781–2788 manufactured by Humphrey, Inc. of San Diego, Calif.

The electrical conductors from such a device are fed through part 127 and extend along the length of sleeve 140 in cable 96 to an out of the hole receiver-indicator via cable 259 (FIG. 1).

Figure 3:
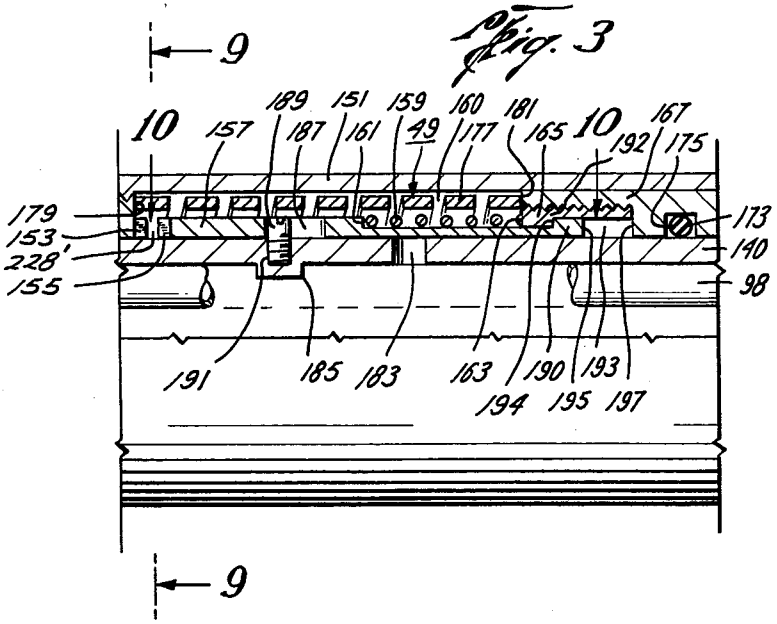
Figure 10:
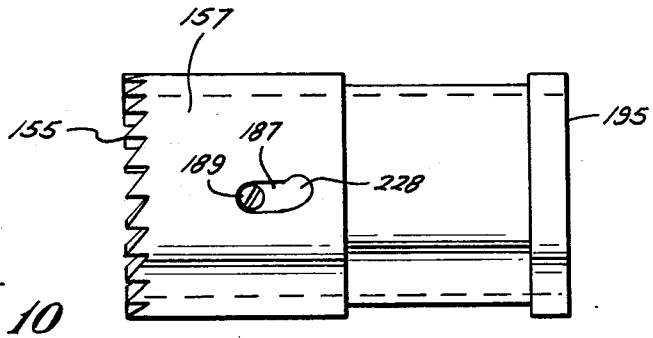
Figures 4, 5, 11, 12, 13:
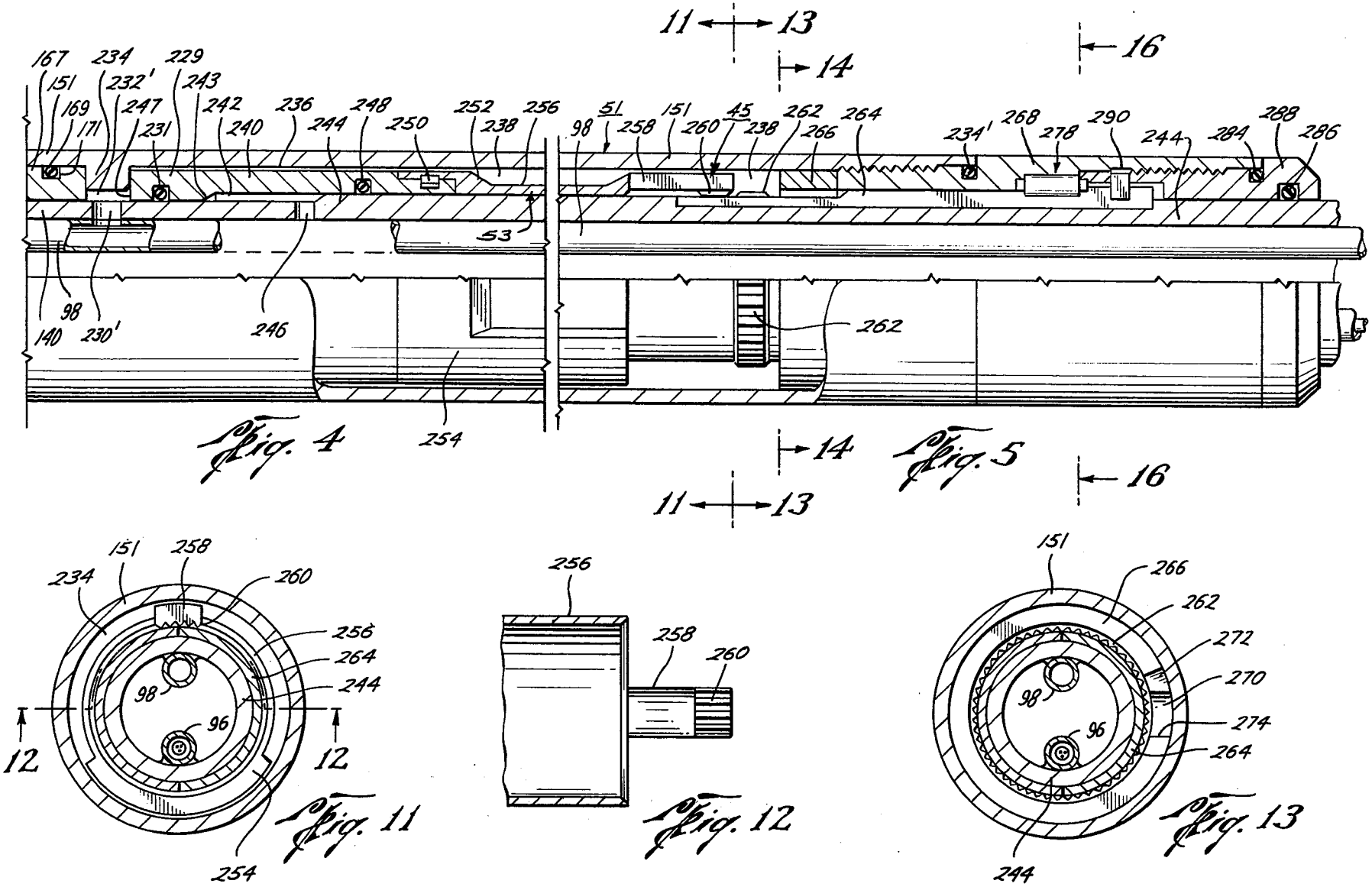

Referring now to FIGS. 2, 3 and 4, to turn the deflection barrel 41 to the desired position azimuthally about the inner end shaft 64, sleeve 133 is connected to sleeve 151 of hydraulic stepping motor 49 in chamber 160. It is driven by fluids in conduit 98.

Chamber 160 is formed between sleeve 151 and sleeve 140 which is a part of shaft 33. Piston sleeve 167 is threaded or otherwise attached over split piston 165. Chamber 160 is sealed by piston sleeve 167 sealingly engaged with sleeve 151 by seal 169 placed in groove 171 of sleeve 167 and also sealingly engaged with sleeve 140 by seal 173 in groove 175 of piston sleeve 167. It is also sealed by sleeve 133 sealingly engaged with sleeve 140 by seal 149 and with sleeve 151 by seal 147. Orifice 183 provides fluid tight flow communication between chamber 160 and tubular shaft or sleeve 140, member 157 being axially movable on sleeve 140 and hence not in fluid tight engagement therewith.

As part of hydraulic stepping motor 49, spring 159 is positioned in chamber 160 and is held in compression between shoulder 161 of piston follower sleeve 157 and shoulder 163 of piston 165. Hydraulic stepping motor 49 includes teeth 153 milled into sleeve 133. Teeth 153 are positioned to engage with teeth 155 milled or cut in piston sleeve 157. Spring 159 is of such strength as to hold teeth 155 in engagement with teeth 153 as teeth 153 and sleeve 133 rotate and without relative movement of piston sleeve 157 with respect to piston 165. Spring 177 is positioned in chamber 160 and is held in compression between shoulder 179 of sleeve 133 and shoulder 181 of piston sleeve 167. Alignment slot 187 is provided in piston sleeve 157 with screw 189 passing through alignment slot 187 and engaging threaded opening 191 in enlarged portion 185 of sleeve 140. Annular space 193 is formed between shoulder 197 of piston sleeve 167 and shoulder 195 of outer end enlargement 190 of piston sleeve 157.

The length of space 193 has a direct functional relationship to the distance 228' between teeth 153 and teeth 155 and to the total length of slot 187 so that when piston 165 is moved axially teeth 153 will mesh with teeth 155 thereby rotating sleeve 133 until the points of teeth 155 come in contact with the valleys of teeth 153. The length of slot 187 further permits shoulder 197 of piston sleeve 167 to urge piston sleeve 157 to cam around screw 189 into slot 228 while teeth 153 and 155 are engaged, further rotating sleeve 133 thereby permitting teeth 155 upon disengagement from teeth 153 to become positioned behind teeth 153 to again cause rotation of sleeve 133 on the next engagement of teeth 153 with teeth 155. Enlargement 190 is longitudinally abutted with enlargement 192 of piston 165 at shoulder interface 194 prior to each actuation of piston sleeve 167.

Referring now to FIGS. 4 and 5, to actuate piston 165, port 230' is provided in sleeve 140 to permit fluid tight flow communication betwen hydraulic fluid channel 98 and annular chamber 232' formed by flange 234 of sleeve 151, sleeve 140, piston sleeve 167 and piston 229 in cooperation with seals 173, 169 and 231.

Piston 229 is formed between sleeve 151 and sleeve 140 facing oppositely to piston 165; with one driving surface 247 facing chamber 232', previously described. Annular channel 236 is formed between sleeve 151 and piston 229 to provide for drainage between chamber 238, formed between sleeve 151 and piston extension 256, and annular chamber 232'.

Piston 229 is provided with thin walled section 240 which in cooperation with sleeve 140 and its upset section 244 forms annular chamber 242 with driving surface 243 for piston 229. Port 246 is provided in sleeve 140 to permit fluid communication between annular chamber 242 and tubular shaft or sleeve 140. Chamber 242 is made fluid tight by seals 231 and 248. Sleeve upset section 244 also slidingly supports thin walled section 240 and weight attachment member 252. Weight 254 is provided as a part of weight attachment member 252, said member being free to rotate about sleeve upset section 244 by bearing connection 250 provided between thin walled section 240 and attachment member 252.

Referring now to FIG. 5, to determine the current position of pistons 81, 83 in order to orient pistons 81, 83 azimuthally with respect to the axis of motor shaft 23, extension 256 is provided for weight attachment member 252 terminating in finger 258 having splines 260 thereon. Spline ring 262 is provided around split sleeve 264 and is shrunk fit thereover to hold sleeve 264 to sleeve 244. Spline ring 262 prevents extension 256 from rotational motion by engaging splines 266 on finger 258. Mandrel sleeve 264 does not rotate during rotation of sleeve 151.

Sleeve extension member 268 is screwed into sleeve 151 and sealed thereto with resilient O-ring 234'. Shoulder stop 266 is provided on extension member 268 to prevent longitudinal motion of finger 258 beyond spline 262. Shoulder stop 266 is provided with slot 270 formed between bevel 272 leading to slot 270 on one side of slot 270 and with straight side 274 bordering slot 270 on the other side. Slot 270 is of sufficient depth and width to permit the insertion of finger 258 therein to permit the extension of splines 260 beyond engagement with spline 262.

Sprague clutch 278 is provided in annular opening (See FIG. 16) with locking members 282 connected by spring band 280 to permit rotation of sleeve 151 in only one direction relative to sleeve 140 (244), allowing azimuthal positioning of deflection barrel 141, but preventing reactive rotation of motor housing 31 when motor 25 is actuated to rotate bit 21.

Referring again to FIG. 5, a split thrust bearing ring 290' is disposed in annular space 290. The inner periphery of the ring lies in an annular groove in sleeve 264. The outer periphery of the ring lies between the inner end of locking member 288 and a junk ring or washer adjacent Sprague clutch 278. The thrust bearing ring transmits axial force from upset section 244 of sleeve 140 to extension member 268, the latter forming the outer end of motor housing extension 51. By means of this thrust bearing ring, axial force can be transmitted from the force applicator 27 (FIG. 1) to the housing of motor 25, and through the thrust bearings in motor 25 and the outboard thrust bearings 67, 69 (FIG. 2A) to the bit, 21. The thrust bearing ring allows rotation of extension member 268 relative to upset section 244, so that deflection barrel 141 can be azimuthally positioned relative to section 244 when desired, although it will be recalled that Sprague clutch 278 limits such rotation to one direction. Seals 284, 286 seal locking member 288 with rotation extension member 268 and with sleeve upset section 244 rotatable therewithin.

Figure 17:
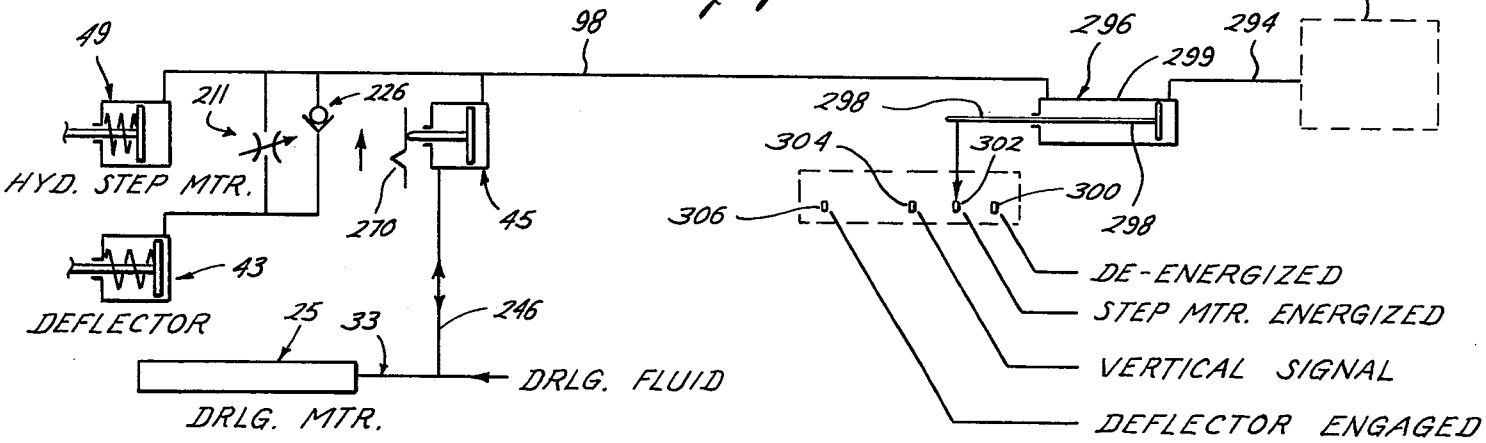
FIG. 17 is a hydraulic circuit diagram for the position control system forming part of the apparatus embodying the invention.

Referring now to FIG. 17, to operate the positioning mechanism, hydraulic power pack 292 is provided in fluid tight flow communication by hydraulic fluid pipe 294 to fluid volume indicator 296. Fluid volume indicator 296 is composed of cylinder 299 with piston indicator 298. The position of piston indicator 298 is representative of the volume of fluid presently contained in the system supplied by hydraulic fluid line 98. As previously discussed, hydraulic fluid line 98 may have only its initial or line fluid in it, i.e., when pistons 81, 83 of wall engagement means 43 are not extended and orientation is not occurring. This would be indicated by piston indicator 298 in the "de-energized" position 300. When the hydraulic stepping motor 49 and sequencing clutch 45 are energized, but sequencing clutch 45 is not in its extended pisition, "extended position" referring to extension of finger 258 into slot 270, sufficient hydraulic fluid will be in the system for indicator 298 to be in the "Stepping motor energized" position 302. When finger 258 enters slot 270, sufficient hydraulic fluid will have entered the system for indicator 298 to be in the "Vertical signal" position 304. After sufficient time, when pistons 81, 83 of wall engagement means 43 have been extended by hydraulic fluid flow through the time delay restriction valve 211 from line 98, and after proper orientation made by counting the steps from "vertical," sufficient hydraulic fluid will have entered the system for indicator 298 to be in the "Deflector engaged" position 306.

In operation of the apparatus, the motor 25 is actuated by power fluid flowing through shaft 33, and piston rod 35 from hose bundle 29, to rotate bit 21. The bit is forced inwardly against the end of the hole by the force applicator 27. At the same time, the wall engagement means 43, including deflection barrel 41, may be actuated to press the bit 21 laterally toward the opposite side of the hole 87 (FIG. 2A) in a desired direction. Because limiters 70 are nonrotating, if the rate of change limiters 70 are forced against the opposite side of hole 87, pressure may be let off pistons 81, 83, to permit the limiters to lift off hole 87. If it is desired only to drill straight ahead, the wall engagement means 43 will not be activated except as required to correct course. In any case, as drilling proceeds, the wall engagement means 43 is carried along in the hole with the in-hole motor 25. The drilling apparatus may be removed periodically and the hole direction surveyed or direction sensing apparatus may be incorporated in the drilling apparatus to give a continuous indication of hole direction. In either case, if a change of direction is desired, the deflection barrel 41 is rotated to set it to press the bit 21 in the desired direction and drilling continued with the wall engagement means 43 active, its pistons 81, 83 being extended, until the desired change in direction is achieved.

In order to rotate the deflection barrel 41 about the axis of motor 25, motor 25 is first stopped by stopping fluid flow through shaft 33. Hydraulic fluid pressure is then applied from hydraulic power pack 292 to hydraulic fluid channel 98. The application of this hydraulic fluid will have the effect of urging fluid into chamber 232' forcing piston sleeve 167 toward shoulder 179 and piston 229 toward shoulder 266. A small amount of fluid will also enter restrictive orifice 211, but, because of the size of passage 224, the amount of fluid will not be sufficient to actuate pistons 81, 83 of wall engagement means 43. The fluid will not build up but will drain through check valve 226 when pressure is decreased in hydraulic fluid channel 98.

As shoulder 197 approaches shoulder 195, the points of teeth 155 will engage the flanks of teeth 153 in cooperation with spring 159 and continue along the faces of teeth 153 to the valleys of teeth 153 thereby rotating connector 133 and all sleeves connected to it, including barrel 41 and sleeve 151. When teeth 155 reach the valley of teeth 153, screw 189 will have reached the slot 228 of hole 187 and shoulder 197 will have engaged shoulder 195. This will permit piston sleeve 157 to rotate with connector 133 as screw 189 travels up slot 228. When screw 189 has reached the end of the travel of slot 228, fluid pressure is decreased from hydraulic power pack 292 to allow fluid drainage through check valve 226 and to permit spring 177 to return piston sleeve 167 and piston 165 to their original positions. This also causes a slight backward rotation of piston sleeve 157 as screw 189 is traversed in reverse by slot 228. The backward rotation of piston sleeve 157 will again position the points of teeth 155 opposite the flank of teeth 153 for the next engagement and rotation of the teeth. The stepping of hydraulic motor 49 just described will be indicated by the fluctuation of indicator 298 about demarcation 302 after initial longitudinal travel from demarcation 300. The urging of piston 165 toward shoulder 179 will cause drill motor driving fluid to be drained through port 183 from chamber 160 and through port 246 from chamber 242 to sleeve 140.

Piston 229, having also been urged toward shoulder 266 by the action of hydraulic fluid in chamber 232', will force finger 258 to travel through chamber 238 and frictionally contact the end of shoulder 266. Because splines 260 will be engaging spline ring 262 and bearing 250 permits relative rotation of piston 229 with weight attachment member 252, finger 258 will not rotate even though shoulder 266 will rotate with sleeve 268 as the hydraulic motor 49 is stepped. Therefore finger 258 will remain vertically aligned by virtue of weight 254 and spline ring 262. By continuing to step motor 49 however, eventually shoulder 266 will rotate to a position where slot 270 will be opposite finger 258. At this position, the hydraulic fluid acting through piston 229 will urge finger 258 into slot 270 which will be indicated by the longitudinal movement of indicator 298 to marking 304.

When finger 258 enters slot 270, slot 270 will have to be at the top of the assembly because weight 254 in cooperation with thrust bearing 250 and spling ring 262 has kept finger 258 at the top, as previously discussed. Therefore, because the positional relationship between slot 270 and pistons 81, 83 is known, the positions of pistons 81, 83 are also known. When finger 258 enters slot 270, weight attachment member 252 and weight 254 are free to rotate with shoulder 266 using thrust bearings 250. Therefore pistons 81, 83 may be positioned by continued use of hydraulic stepping motor 49 with position indication given by the number of steps of motor 49 using finger 258 engaged in slot 270 as a starting reference.

When the pistons 81, 83 have been correctly positioned in hole 87 for proper deflection of bit 21, sustained hydraulic fluid pressure can be maintained in hydraulic fluid channel 98 until sufficient fluid has passed through restriction valve 211 to force pistons 81, 83 outward, engaging the hole which is indicated by indicator 298 moving longitudinally to position 306. Then, fluid may be introduced through shaft 33 which will start drilling motor 25 and also force piston 229 back to abutment with flange 234 by fluid pressure through shaft 33 to orifice 246 to chamber 242 acting against shoulder 243. This action will also disengage finger 258 from hole 270 and move splines 260 to their initial position disengaged from spline ring 262. Check valve 226 is also used to drain fluid from pistons 81, 83 when these are to be contracted.

Although the system as described in detail supra has been found to be most satisfactory and preferred, different applications and many variations in its elements and the structure of its elements are possible. For example, fluid can be introduced into port 183 from sleeve 140 to return piston 165 and piston sleeve 167 instead of using spring 177. Moreover instruments such as inclinometers, accelerometers, and analyzers may be housed in instrument package 34.

The above are merely exemplary of the possible changes or variations.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed as invention is:

1. Drilling apparatus comprising an in-hole assembly adapted to be run in a hole being made, said in-hole assembly including, an in-hole motor having a shaft rotated when the motor is actuated, said shaft being adapted to rotate a drill bit, a deflection barrel rotatable about the shaft axis, positioning means for turning the barrel to a desired azimuthal position relative to the axis of rotation of the motor shaft and holding it in that position, said positioning means including a single hydraulic line for actuation, and said apparatus further comprising command means for directing said positioning means through said single hydraulic line, said deflection barrel including means extendable from the side thereof to engage one side of a hole being drilled and means to push the shaft laterally toward the opposite side of the hole, said in-hole motor including a housing, said deflection barrel being connected to said housing and said positioning means turning said barrel along with said motor housing.

2. Apparatus according to claim 1 wherein said means to push the shaft laterally includes an annular cuff connected to he inner end of the barrel and a sub connected to the inner end of the shaft and antifriction bearing means between said cuff and sub.

3. Apparatus according to claim 1 including a bit connected to said shaft and torque anchor means connected to said housing.

4. Apparatus according to claim 1 including force applicator means connected to said housing.

5. Apparatus according to claim 1 wherein said means extendable from the side of the barrel to engage the side of the hole being drilled includes a tubular cover inside the barrel to form an annular pressurable chamber therebetween, piston means radially extendably and retractably mounted in a window in the barrel adjacent said chamber.

6. Apparatus according to claim 5 wherein said piston means is mounted in said window by elastomer means bonded to the piston and window.

7. Apparatus according to claim 1 including transmitting means connected to the barrel responsive to the attitude position of the barrel relative to the axis of the hole being drilled for transmitting an indication of the attitude position of the barrel to an out of the hole indicator.

8. Apparatus according to claim 7 wherein said transmitting means is a mercury potentiometer connectible to an out-of-the-hole indicator of the Wheatstone bridge type, said potentiometer to form part of the circuit of said bridge.

9. Apparatus according to claim 1 wherein said positioning means includes a hydraulic stepping motor and detection means for determining when said barrel reaches a known position.

10. Apparatus according to claim 9 wherein said command means includes indicator means for indicating the detection by said detection means of said barrel reaching said known position.

11. Drilling apparatus according to claim 1 comprising:

an in-hole force applicator;

said in-hole assembly connected to said applicator.

12. Drilling apparatus according to claim 11:

actuation means for moving said positioning means including a single hyraulic line.

13. Deflection apparatus of claim 12, comprising:

means detecting a known position of the apparatus through the same single line.

14. Apparatus according to claim 12 further including rate of change limiting means for limiting the amount of deflection of said drill bit.

15. Apparatus according to claim 14 wherein said rate of change limiting means is nonrotatable.

16. Drilling apparatus adapted to be run in a hole being made, said apparatus comprising:

an in-hole motor including a housing and having a shaft rotated relative to said housing when the motor is actuated, said shaft being adapted to rotate a drill bit when said motor is actuated and said housing is held against rotation, a deflection barrel connected to said motor housing, said deflection barrel including means extendable from the side thereof to engage one side of a hole being drilled and means to push the shaft laterally toward the opposite side of the hole, shaft means to apply force to said motor housing and take counter torque thereof when it is desired to rotate said drill bit, connection means connecting said shaft means to said motor housing to prevent relative axial motion thereof and to permit relative rotation thereof in one direction for positioning of said deflection barrel and to prevent relative rotation thereof in the opposite direction as required to take counter torque when it is desired to rotate said drill bit; and positioning means for turning the barrel to a desired azimuthal position relative to the axis of rotation of the motor shaft and holding it in that position.

17. Drilling apparatus according to claim 16, said connection means including a thrust bearing and an overrunning clutch.

18. Apparatus of claim 3, comprising:

orienting means located in the hole for turning the deflection barrel about such shaft axis;

said one hydraulic line for transmitting commands to said positioning means.

19. Apparatus according to claim 16 wherein there is further included:

detection means for detecting a known position of said deflection barrel and transmitting such detection through said one hydraulic line.

* * * * *

UNITED STATES PATENT AND TRADEMARK OFFICE

CERTIFICATE OF CORRECTION

PATENT NO. :4,040,494

DATED :August 9, 1977

INVENTOR(S) :Jackson M. Kellner

It is certified that error appears in the above-identified patent and that said Letters Patent are hereby corrected as shown below:

In the abstract, line 1, delete "axis"; line 3, after "motor" insert --axis--.

Column 3, line 13, following "31" insert a period (.).

Column 3. line 14, change "cover" to --Cover--.

Column 3, line 66, change "part" to --port--.

Column 4. line 57, change "betwen" to --between--.

Column 8, line 47, change "he" to --the--.

Column 8. line 53, change "1" to --3--.

Column 10. line 24, change "3" to --16--.

Column 10, line 25, delete the entire line.

UNITED STATES PATENT AND TRADEMARK OFFICE

CERTIFICATE OF CORRECTION

PATENT NO. : 4,040,494

DATED : August 9, 1977

INVENTOR(S) : Jackson M. Kellner

It is certified that error appears in the above-identified patent and that said Letters Patent are hereby corrected as shown below:

Column 10, line 27, delete "said".

Column 10, line 29, change "16" to --18--.

Column 2, line 36, after "means" insert --42--.

Column 10, line 26, delete the entire line.

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*